United States Patent [19]

Olbrisch et al.

[11] Patent Number: 4,948,350

[45] Date of Patent: Aug. 14, 1990

[54] HOSE PUMP

[75] Inventors: Walter Olbrisch; Wolfgang Suttner, both of Bielefeld, Fed. Rep. of Germany

[73] Assignee: Suttner GmbH & Co. KG, Fed. Rep. of Germany

[21] Appl. No.: 400,543

[22] Filed: Aug. 30, 1989

[51] Int. Cl.[5] ..... F04B 43/08

[52] U.S. Cl. ..... 417/474; 417/479; 604/153

[58] Field of Search ..... 417/412, 474, 478, 479, 417/482, 483, 484; 604/153; 128/DIG. 12

[56] References Cited

U.S. PATENT DOCUMENTS

| | | | |
|---|---|---|---|
| 2,816,514 | 12/1957 | Freese . | |
| 3,170,360 | 3/1965 | Walton | 417/474 |
| 3,182,602 | 5/1965 | Price | 417/474 X |
| 3,418,940 | 12/1968 | Martin | 417/474 X |
| 3,518,033 | 6/1970 | Anderson | 417/478 |
| 3,778,195 | 12/1973 | Bamberg | 417/479 X |
| 4,015,914 | 4/1977 | Kushner et al. | 417/479 X |
| 4,252,447 | 2/1981 | Borodin | 417/474 X |
| 4,479,797 | 10/1984 | Kobayashi et al. | 604/153 |
| 4,501,405 | 2/1985 | Usry | 417/412 X |

FOREIGN PATENT DOCUMENTS

| | | | |
|---|---|---|---|
| 1240741 | 5/1967 | Fed. Rep. of Germany . | |
| 2430450 | 1/1976 | Fed. Rep. of Germany . | |
| 59-093979 | 5/1984 | Japan | 417/478 |
| 60-043188 | 7/1985 | Japan . | |
| 2020735 | 11/1979 | United Kingdom . | |
| 3741262 | 6/1989 | United Kingdom | 417/479 |

OTHER PUBLICATIONS

Lexicon of Technology (Lexikon der Technik), vol. 7, Lexicon of Power Technology and Engines, DVA, Stuttgart, 1965, p. 264.

Lexicon of Technology (Lexikon der Technik), vol. 13, Lexicon of Precision Technology, pp. 86, 87.

*Primary Examiner*—Leonard E. Smith

*Assistant Examiner*—Eugene L. Szczecina

[57] ABSTRACT

A hose pump with a pump casing (1) has a hose (2) running in a closed manner through it. The hose (2) rests on a support wall (3) of the pump casing (1) and compression elements (4, 5) squeeze-off the hose (2) in at least two places. A drive (6) for the movement of the compression elements (4, 5) becomes considerably more economical because the hose (2) is located between the support wall (3) and compression plate (9) and is sharply bent around an end of compression plate (9) that serves as the first compression element (4) with a bend of about 180°, and the second compression element (5) is placed opposite the support wall (3) on the other end of compression plate (9). The compression plate (9) and second compression element (5) can be moved back and forth by the drive (6) between a first pump position (I) and second pump position (II), the second compression element (5) being further from support wall (3) in the first pump position (I) than in the second pump position (II). In first pump position (I) hose (2) is essentially relaxed and second compression element (5) does not squeeze it off, and on the way from first pump position (I) to second pump position (II), the second compression element (5) and then the compression plate (9) squeezes off the hose.

20 Claims, 3 Drawing Sheets

HOSE PUMP

BACKGROUND OF THE INVENTION

The invention relates to a hose pump, in particular for metering devices in water treatment units, with a pump casing and with a hose for the medium to be pumped that runs through the pump casing in a closed manner, resting on a support wall of the pump casing. In particular, to such an arrangement wherein compression elements are provided for squeezing off the hose in at least two places, and a drive is provided for opening and closing the compression elements in a specific sequence so as to convey a specific volume of liquid through said hose.

Hose pumps are used for metering devices in water treatment units, such as laboratory pumps, for conveying small amounts of a medium to be pumped and also for metering purposes in the medical field. In part, hose pumps are also driven virtually continuously, and thus, are used as pure feed pumps. The medium to be pumped is most often a liquid, for example, water mixed with chemicals in a water treatment unit, a chemical solution, etc.

The known hose pump, from which the invention starts (LUEGER "LEXIKON DER TECHNIK," [Lexicon of Technology] volume 7, "LEXIKON DER ENERGIETECHNIK UND KRAFTMASCHINEN," [Lexicon of Power Technology and Engines], DVA, Stuttgart, 1965, page 264) exhibits a pump casing with a circular interior, whose inner wall presents a support wall for a hose. The hose runs from an intake in a circular loop to an outlet of the pump casing. Concentrically in the pump casing is located the driving shaft of a rotary drive, most often an electric motor, on which a rotating disk sits. On this disk there rest rollers which revolve in planetary fashion and which are pressed by elastic force against the hose made of elastic material, which is wound around the support wall, and press the hose together at regular intervals. As a result, the hose volume located between the two rollers is separated from the suction side and is conveyed to the pressure side. These hose pumps are known to have two, three or even four revolving rollers.

In another design of a hose pump (LUEGER, op. cit.), the pumping effect is achieved by an eccentric rolling piston which shifts in the interior of the pump casing and at the same time presses a ring of elastic material against the support wall. Here, too, the drive is necessarily a rotary drive, therefore most often an electric motor.

The delivery of the known hose pumps must be adjustable, particularly when they are used in metering devices. This necessitates an adjustability of the speed of the driving electric motor. This in turn necessitates relatively expensive control electronics. Overall, the known hose pumps are relatively expensive, on the one hand, because they require an electric motor as a drive, and on the other hand, because they require an electronic speed control.

SUMMARY OF THE INVENTION

A primary object of the invention is to simplify the design of the known hose pump so that it is considerably less expensive than the previously known hose pumps.

This object is achieved in a hose pump according to the present invention by having the hose arranged in an essentially stationary manner between the support wall and a compression plate with the hose being sharply bent around an end of the compression plate, which serves as a first compression element, creating a bend in the hose of about 180° and squeezing it off. Furthermore, on the other end of the compression plate, a second compression element is placed opposite the support wall, and the compression plate with the second compression element are movable back and forth by the drive in a pumping movement between a first pump position and a second pump position, the first pump position being at a greater distance from the support wall than the second pump position. In the first pump position, the hose is essentially relaxed and the second compression element does not squeeze off the hose, and on the way from the first pump position to the second pump position, first the second compression element and then the compression plate squeezes off the hose.

An important aspect of the invention lies in the recognition that simply bending the hose about 180° leads to a squeezing off of the hose which is reliable under normal pressure conditions and to a blocking of the hose. Furthermore, it is also important to recognize that such squeezing off as is achieved by bending of the hose can be overcome when the liquid pressure in the hose increases and therefore, such squeezing off can produce a valve function. This effect, of course, has long been known as such, but now it is specifically applied, here, in a hose pump, to eliminate the use of circular compression elements as in the device from which the present invention was developed. Upstream from the bending of the hose, as provided according to the invention, a stationary second compression element is placed, which has almost the same function as the first compression element, which closes so as to guarantee the closing off of the hose that is necessary for building up the required liquid pressure in the area between the support wall and the compression plate.

In contrast to the initially mentioned prior art, the squeezing off of the hose necessary for conveying of liquid is no longer achieved by the turning circular compression elements, but rather by the static compression plate. The conveying of the liquid through the hose past the first compression element is possible since, by the pressure increase in the area between the support wall and the compression plate, the hose becomes somewhat inflated at the bend and allows a flow of the liquid. Because when the second pump position is reached the pressure in the hose between the support wall and the compression plate immediately declines, the valve formed by the bending at the first compression element immediately closes again. When the compression plate is again removed from the support wall and when the return to the first pump position occurs, the pressure is released from the hose and the hose is widened after opening the second compression element under its residual stress and/or under the pressure of the liquid at the intake of the hose and is filled up with liquid. After that the pumping cycle can then run again.

According to the invention, it is, therefore, possible to completely dispense with a rotary drive since only a back and forth movement is necessary for the actual movement of the pump. The drive and control possibilities available for this purpose are considerably simpler and less expensive to realize than with the electric motors with electronic speed control known until now. As a result, the hose pump according to the invention is far less expensive to produce than such known hose pumps.

In this regard, it should be pointed out that a drive with a linear drive movement is much less expensive than a rotary drive, particularly when the drive is constructed as a control magnet. By adjusting the drive frequency when using a control magnet, in other words the play frequency of the control magnet, the delivery of the hose pump, according to the invention, can be controlled very simply. When an alternating current oscillating magnet is used, it is possible to work with the network frequency as a play frequency, so that the hose pump, according to the invention, can, then, be used as a virtually continuous feed pump. Additionally the delivery of the hose pump according to the invention can be adjusted very precisely to low values so that it can be used as a very precisely working metering pump.

Further special features, objects and advantages of the hose pump according to the invention will become apparent from the following description of a preferred embodiment when viewed in conjunction with the accompanying drawings.

DETAILED DESCRIPTION OF THE PREFERRED EMBODIMENT

Figure 2:
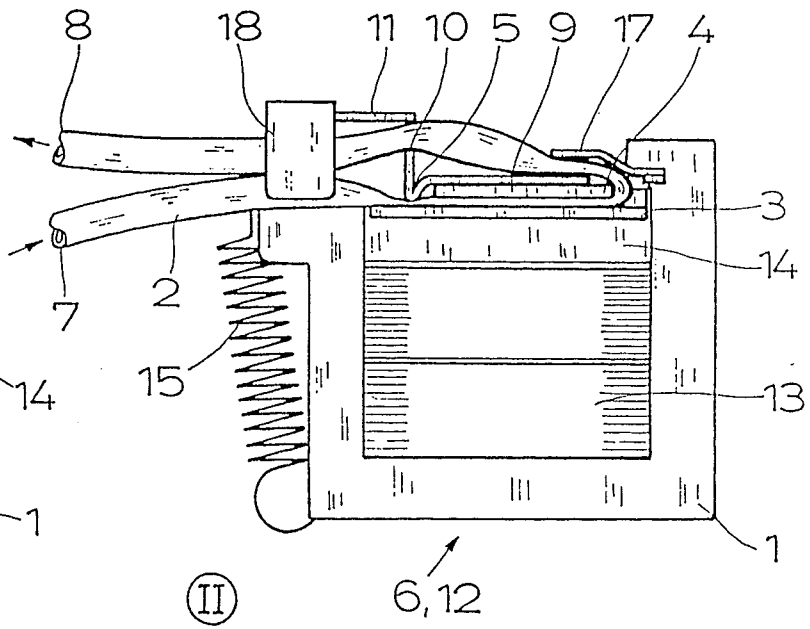
FIG. 2 is an elevational view corresponding to that of FIG. 1, but with the hose pump in a second pumping position.

The embodiment of a hose pump according to the invention represented in the figures of the drawing is particularly intended and suited for metering devices in water treatment units. In a form with other dimensions, or optionally somewhat modified, such a hose pump could also be used for medical applications, for example, as an infusion metering pump. Also, with a correspondingly high drive frequency, this hose pump could be used as a virtually permanent pump with considerable delivery.

The hose pump represented comprises, first of all, a pump casing 1 and a hose 2 running in a closed manner through pump casing 1. Hose 2 rests on a support wall 3 of pump casing 1 and conveys the medium to be pumped in a closed flow. In particular, this medium may be in the form of a liquid, for example, water mixed with chemicals. In at least two places, compression elements 4, 5 are provided to squeeze off hose 2. Compression elements 4, 5 are driven or moved by a drive 6. By opening and closing compression elements 4, 5 in a specific sequence, a specific amount of the medium to be pumped, in other words, the liquid in particular, can be conveyed through the hose, namely, from intake 7 to outlet 8.

An important aspect of the invention is that hose 2 lies essentially stationary between support wall 3 and a compression plate 9 and is bent at a sharp 180° angle around one end of compression plate 9. This compression plate 9 serves as a first compression element 4 and the hose is squeezed off thereby. The first place of compression is, thus, achieved by this bend at the end of compression plate 9. At the other end of compression plate 9, the second compression element 5 is placed opposite support wall 3.

Figure 1:
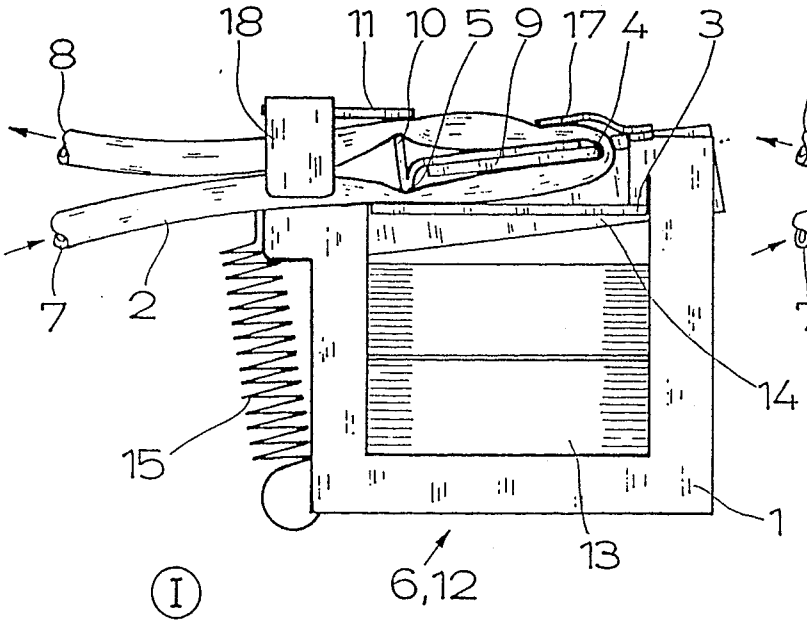
FIG. 1 is a front side, elevational view of a hose pump according to the invention in a first pumping position.

Compression plate 9 and second compression element 5 placed on it can be moved back and forth by drive 6 between a first pump position I, represented in FIG. 1, and a second pump position II, represented in FIG. 2, compression plate 5 being located at a greater distance from support wall 3 in position I than in position II. This back and forth movement, in contrast to the rotary movement of the compression elements realized in the above described prior art, is designated, hereafter, as pumping movement.

In first pump position I, hose 2 is essentially relaxed, thus, it has its normal volume in the area between support wall 3 and compression plate 9. Second compression element 5 does not squeeze off hose 2 in pump position I, so that liquid can enter, from intake 7, into the area between support wall 3 and compression plate 9.

On the way from first pump position I into second pump position II, at first, second compression element 5 squeezes off hose 2, so that the liquid in the area of hose 2 located between support wall 3 and compression plate 9 cannot flow back to intake 7. After that, in the further course of the movement in the direction of second pump position II, compression plate 9 squeezes hose 2 against support wall 3. Since first compression element 4, formed by the end of compression plate 9, remains unaffected by this movement and the squeezing effect in this place is actually accomplished merely by simple bending of hose 2, the liquid pressure produced in hose 2, between support wall 3 and compression plate 9, is sufficient to open hose 2 a little at the bend and to force the liquid through at this place.

Thus, the liquid discharges completely from the area of hose 2 between support wall 3 and compression plate 9 into the area of hose 2 beyond first compression element 4 until compression plate 9 reaches pump position II. Since, when second pump position II is reached, the pressure in hose 2 between support wall 3 and compression plate 9 decreases, the bend immediately closes hose 2 again at first compression element 4, so that a backflow of liquid is impossible. If compression plate 9 returns back into first pump position I, then hose 2 between support wall 3 and compression plate 9 is released and is again inflated under its residual stress and/or on account of the liquid pressure at intake 7 immediately after the opening of second compression element 5 and fills up with liquid between support wall 3 and compression plate 9.

The pump operation, described above, is repeated with the drive frequency of drive 6 and thus, leads to the desired pumping action.

Essential to the above explained design is its special simplicity and the consequent possibility of dispensing with an electric motor as drive 6 since, with the inventive design, a rotary movement of compression elements 4, 5 is not necessary.

A comparison of FIGS. 1 and 2 makes it possible to clearly recognize how a bulge of liquid moves through hose 2 between pump positions I and II. Thus, it should be recognized that, in the embodiment represented here, a third compression element 10 is placed downstream from first compression element 4. The third compression element 10, in conjunction with support 11, squeezes off the hose 2 in the first pump position I and does not squeeze off the hose 2 in the second pump position II. This third compression element 10, in conjunction with support 11, serves as an additional safety measure.

Compression elements 5 and 10, in the embodiment represented here, are moreover designed as simple squeezing edges, for example, on an appropriately bent metal strip. The support 11 is a plate that is also formed of a rigid metal strip. Other embodiments are, of course, conceivable. In any case, care must be taken to insure that hose 2 is not damaged by the squeezing off even in continuous operation.

Basically, the pumping movement of the compression plate 9 and the second compression element 5 (and also of the third compression element in the embodiment represented here) can be a linear movement. However, in the illustrated embodiment, the pumping movement involves a swinging or pivoting movement. The swinging movement utilized in the preferred embodiment represented has the advantage that second compression element 5 accomplishes the squeezing off of hose 2 earlier than compression plate 9, at a point that is "upstream" in the direction of the movement from compression plate 9 and closer to the axis of rotation, simply by its geometrical placement and without special additional measures. Second compression element 5, thus, protrudes in a direction toward support wall 3 from a point alongside compression plate 9.

In particular, in producing a pump movement by a swinging compression movement, it is recommended that the second compression element 5 be able to be pulled down, against an elastic force that is sufficient to return it to pump position I, when it is driven toward the support wall 3 to squeeze off the hose. This does entail a somewhat greater technical investment, but it leads to less wear and tear of the hose on the second compression element.

It has already been explained above that a special advantage of the hose pump according to the invention is that a drive 6 can be used with a linear drive movement to produce the noted swinging movement. It is also possible to use a drive that causes a rotating drive movement, since obviously a linear drive movement can be produced from a rotating drive movement at any time by a crank mechanism. However, a linear drive movement possibly has significant advantages for the design of drive 6 in terms of cost.

In particular, this is true when drive 6 is a control magnet 12, as is the case in the embodiment represented here. A control magnet consists of a magnet body 13 and armature 14, by which the mechanical force effect of an electromagnetic field is used to carry out a specific lengthwise or rotary movement. Principal kinds of control magnets are lifting/pulling magnets, rotary magnets and oscillating magnets. There is a further distinction between direct current control driven and alternating current driven magnets, which differ in regard to their mechanical design and in the switching times. The drive frequency of drive 6 is designated its play frequency in the design as control magnet 12 (LUEGER, "LEXIKON DER TECHNIK," Volume 13, "LEXIKON DER FEINWERKTECHNIK" [Lexicon of Precision Technology], page 86, 87).

Figure 3:
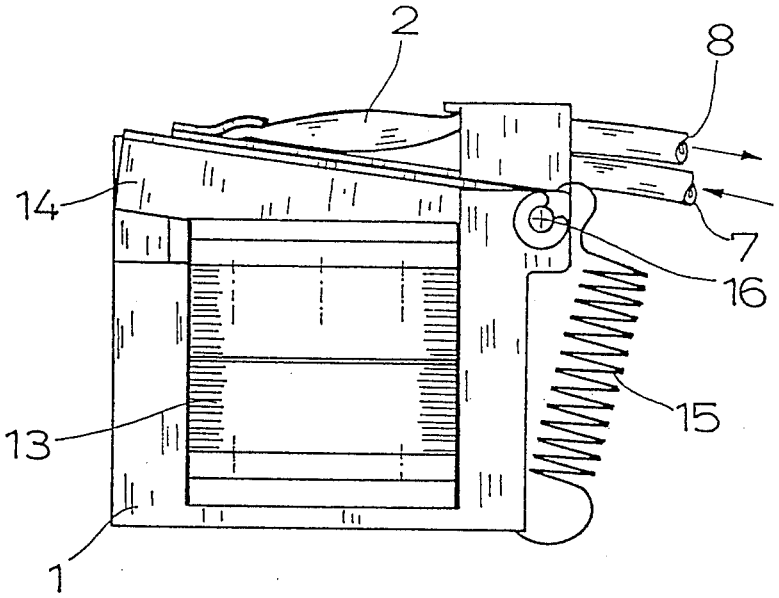
FIG. 3 shows the hose pump of FIG. 1 in a rear side, elevational view.

When the excitation winding is switched on at magnet body 13 of control magnet 12, the armature 14 is pulled in the direction of the increasingly strong magnetic field of magnet bodY 13. The pulling force thus produced is the magnetic force which, taking into consideration the corresponding components of the armature weight, acts to pull the armature on the left of axis 16 toward the support wall 3. Compression plate 9 and second compression element 5 are installed on the armature 14 of control magnet 12 to the left of the axis of rotation 16 so they are drawn toward support wall 3. After the excitation winding is switched off, as a result of residual magnetism there remains a holding force so that, to move armature 14 back into the initial lifting position, an elastic force, usually provided by a return spring 15, is necessary. As shown in FIG. 3, return spring 15 is attached to the end of armature 14 at the right side of the axis of rotation 16. The spring 15 is a tension spring, so that its elastic force acts to lift the armature at the left side of axis 16 back into its position I.

In the embodiment represented here control magnet 12 is designed as a pulling magnet, which represents a particularly inexpensive and optimal solution here as regards the dynamic effect. However, a lifting magnet could be used to push up on the armature with a compression spring moving it downward; although not preferred. As it was explained above, armature 14 could execute a linear movement, but in the embodiment represented here armature 14 executes a swinging movement. That is why armature 14 of control magnet 12 is designed like a bracket and is laterally mounted on magnet body 3 so that it can be swivelled around axis of rotation 16. This can be very clearly recognized from the rear view in FIG. 3.

In the preferred embodiment represented here, a special guidance of hose 2 takes place in the area of first compression element 4, namely, in that a hose guide 17 is installed. The hose 2 runs between hose guide 17 and compression plate 9. FIGS. 1 and 2 of the drawing also show that, in the area of pump casing 1 located to the left, an additional hose guide 18 is provided for hose 2, so that hose 2 cannot slip sideways out of the general arrangement.

Overall, the drawing shows a hose pump according to the invention which is designed with extreme simplicity, and in particular, no longer needs a rotary drive, and instead, manages with a simple control magnet as a drive. Accordingly, the inventive pump is extremely economical, and in comparison to hose pumps known up to now, costs are reduced here by 60 to 80%.

These and further objects, features and advantages of the present invention will become more obvious from the following description when taken in connection with the accompanying drawings which show, for purposes of illustration only, a single embodiment in accordance with the present invention.

We claim:

1. Hose pump, in particular for metering devices in water treatment units, with a pump casing and with a hose for the medium to be pumped that runs through the pump casing in a closed manner, resting on a support wall of the pump casing; wherein compression elements are provided for squeezing off the hose in at least two places, and a drive is provided for opening and closing the compression elements in a specific sequence so as to convey a specific volume of liquid through said hose; wherein the hose is arranged in an essentially stationary manner between the support wall and a compression plate with the hose being sharply bent around an end of the compression plate, which serves as a first compression element, creating a bend in the hose of about 180° and squeezing it off, and a second compression element is disposed on the other end of the compression plate opposite the support wall; and wherein the compression plate with the second compression element are movable back and forth by the drive in a pumping movement between a first pump position and a second pump position, the first pump position being at a greater distance from the support wall than the second pump position; and wherein the relative positions of the compression plate and second compression element with respect to the support wall cause, in the first pump position, the hose to be essentially relaxed without the hose being squeezed-off by the second compression element, and on the way from the first pump position to the second pump position, first the second compression element and then the compression plate to squeeze off the hose.

2. Hose pump according to claim 1, wherein a third compression element is placed downstream of the first compression element, and wherein said third compression element is operable, in conjunction with a hose support, for squeezing-off the hose in said first pump position and for opening the hose in said second pump position.

3. Hose pump according to claim 2, wherein the compression plate and second compression element are mounted for executing a swinging movement about a pivot axis.

4. Hose pump according to claim 1, wherein the compression plate and second compression element are mounted for executing a swinging movement about a pivot axis.

5. Hose pump according to claim 4, wherein said second compression element protrudes from alongside the compression plate toward the support wall.

6. Hose pump according to claim 5, wherein means for applying an elastic force sufficient to raise said second compression element acts on said second compression element, and wherein said drive pulls said second compression element, against said elastic force, in a direction toward the support wall.

7. Hose pump according to claim 6, wherein the drive produces a linear drive movement.

8. Hose pump according to claim 6, wherein said drive comprises a control magnet having a magnet body and an armature; and wherein said compression plate and said second compression element are carried by the armature of the control magnet.

9. Hose pump according to claim 8, wherein said armature of the control magnet is in the form of a bracket and is laterally mounted on the magnet body of the control magnet to swing around axis of rotation.

10. Hose pump according to claim 9, wherein second compression element is disposed on said armature at one side of said axis of rotation and spring means acts on said armature at an opposite side of said axis of rotation for returning said armature to said first pump position after it has been shifted to said second pump position by said control magnet.

11. Hose pump according to claim 9, wherein a compression plate hose guide is installed near an end of the compression plate forming the first compression element; and wherein the hose runs between the compression plate hose guide and the compression plate.

12. Hose pump according to claim 1, wherein said second compression element protrudes from alongside the compression plate toward the support wall.

13. Hose pump according to claim 12, wherein means for applying an elastic force sufficient to raise said second compression element acts on said second compression element, and wherein said drive pulls said second compression element, against said elastic force, in a direction toward the support wall.

14. Hose pump according to claim 13, wherein the drive produces a linear drive movement.

15. Hose pump according to claim 1, wherein said drive comprises a control magnet having a magnet body and an armature; and wherein said compression plate and said second compression element are carried by the armature of the control magnet.

16. Hose pump according to claim 15, wherein said armature of the control magnet is in the form of a bracket and is laterally mounted on the magnet body of the control magnet to swing around axis of rotation.

17. Hose pump according to claim 16, wherein second compression element is disposed on said armature at one side of said axis of rotation and spring means acts on said armature at an opposite side of said axis of rotation for returning said armature to said first pump position after it has been shifted to said second pump position by said control magnet.

18. Hose pump according to claim 16, wherein a compression plate hose guide is installed near an end of the compression plate forming the first compression element; and wherein the hose runs between the compression plate hose guide and the compression plate.

19. Hose pump according to claim 1, wherein a compression plate hose guide is installed near an end of the compression plate forming the first compression element; and wherein the hose runs between the compression plate hose guide and the compression plate.

20. Hose pump according to claim 1, wherein the drive produces a linear drive movement.

* * * * *